US005079592A

United States Patent [19]

Kanis

[11] Patent Number: 5,079,592

[45] Date of Patent: Jan. 7, 1992

[54] CLEANING SYSTEM FOR ELECTROPHOTOGRAPHIC APPARATUS

[75] Inventor: Kenneth R. Kanis, Rochester, N.Y.

[73] Assignee: Eastman Kodak Company, Rochester, N.Y.

[21] Appl. No.: 624,454

[22] Filed: Dec. 10, 1990

Related U.S. Application Data

[63] Continuation of Ser. No. 360,969, Jun. 2, 1989, abandoned.

[51] Int. Cl.[5] ..... G03G 21/00

[52] U.S. Cl. ..... 355/297; 355/272; 355/296

[58] Field of Search ..... 118/652; 355/296, 297, 355/298, 305, 272, 275, 277, 326, 306, 274, 327, 271, 270

[56] References Cited

U.S. PATENT DOCUMENTS

| | | | |
|---|---|---|---|
| 4,030,824 | 6/1977 | Smith | 355/298 |
| 4,251,155 | 2/1981 | Schnall et al. | 355/298 |
| 4,252,433 | 2/1981 | Sullivan | 355/298 |
| 4,349,270 | 9/1982 | Wada et al. | 355/305 |
| 4,465,363 | 8/1984 | Schmitt et al. | 355/297 X |
| 4,618,250 | 10/1986 | Noguchi et al. | 355/305 |
| 4,671,641 | 6/1987 | Kohyama | 355/305 X |
| 4,724,459 | 2/1988 | Ford | 355/326 |
| 4,750,015 | 6/1988 | Ogura et al. | 355/203 |
| 4,767,689 | 8/1988 | Bibl et al. | 430/45 |
| 4,849,785 | 7/1989 | Tanabe | 355/326 |
| 4,899,198 | 2/1990 | Mahoney | 355/297 |

FOREIGN PATENT DOCUMENTS

| | | | |
|---|---|---|---|
| 0022075 | 2/1984 | Japan | 355/305 |
| 0049370 | 3/1987 | Japan | 355/298 |
| 0083769 | 4/1988 | Japan | 355/297 |

*Primary Examiner*—A. T. Grimley
*Assistant Examiner*—Robert Beatty
*Attorney, Agent, or Firm*—Tallam I. Nguti

[57] ABSTRACT

Apparatus for cleaning carrier and toner from surfaces in a copy machine or printer. Two independent cleaning stations are used to remove carrier and toner from different areas in the machine. The location and type of the cleaning stations are arranged so that particles cleaned by both stations are deposited in a common sump or container. The single container is removable by the machine operator to discard the carrier and toner cleaned by both cleaning stations.

10 Claims, 1 Drawing Sheet

CLEANING SYSTEM FOR ELECTROPHOTOGRAPHIC APPARATUS

This is a continuation of application Ser. No. 07/360,969, filed June 2, 1989 now abandoned.

BACKGROUND OF THE INVENTION

1. Field of the Invention

This invention relates, in general to photocopying and, more specifically, to an apparatus for cleaning toner from surfaces in hardcopy producing apparatus.

2. Description of the Prior Art

Printers, copiers, duplicators, and like devices which use a photosensitive member to develop and transfer an image ultimately to a hardcopy output medium, such as a sheet of paper or transparency, can operate in several different modes. An intermediate transfer step is used in some apparatus to transfer the images from the photosensitive member to the paper. In this type of apparatus, the image is first transferred to an intermediate roller, drum, or belt, and then transferred from that member to the paper. When color images are being produced by the intermediate process, the traditional method is to register all of the individual color component images on the intermediate transfer device to form the composite or final color image before transfer to the paper.

Most types of photocopying devices developed the latent images with toner, often in the form of a dry power. Inherent in the process is the need to remove or clean residual toner and carrier from the photosensitive member at various stages, including after the majority of the toner in the developed image has been transferred. In devices with intermediate transfer members, it is desirable to clean toner from both the photosensitive member and the intermediate transfer member.

Customer maintained printers, copiers, and like devices using the electrophotographic process require periodic toner replacement and disposal under normal operating procedures. In order to make such procedures as simple and foolproof as possible, the number and frequency of such operations should be held to a minimum. This includes the number of containers to empty or replace. According to the prior art, some customer maintainable devices achieve this result by combining more than one customer maintainable function into a single replaceable device or cartridge. For example, the toner supply, the cleaned toner reservoir or sump, and the photosensitive member can all be contained in a single removable housing which is removed and replaced with a new one when the toner needs replenished. This eliminates the need for a separate device for removing toner and carrier cleaned from the photosensitive member assuming, of course, that the toner sump is correctly sized to hold all reasonable amounts of cleaned toner without overflow before the cartridge needs replacing because of a lack of unused toner in the cartridge. U.S. Pat. No. 4,750,015, issued on June 7, 1988, teaches a modified version of the above-described approach. In this patent, the photosensitive member and the collected toner container are housed in the same structure which can be removed and replaced. The toner supply is contained in a different structure.

Several U.S. patents describe or teach cleaning systems with various forms of excess toner collection. U.S. Pat. No. 4,767,689, issued on Aug. 30, 1988, shows a fluid development system which collects in a common sump the excess toner from both a developing station and a cleaning station. The developer apparatus, cleaning apparatus, and toner sump are all contained within the same housing, as shown in FIG. 7 of the patent.

U.S. Pat. No. 4,252,433, issued on Feb. 24, 1981, shows a cleaning system for removing toner from an electrostatic recording member. A roll member cooperates with a blade member to form a single cleaning station which removes, collects, and discharges toner through a conduit. U.S. Pat. No. 4,618,250, issued on Oct. 21, 1986, shows a cleaning system which uses a form of a rotating magnetic roller cleaner, which basic principle is used in part of the cleaning system of the present invention.

U.S. Pat. No. 4,030,824, issued on June 21, 1977, shows a guide or conduit member arranged to discharge toner, collected by one cleaning station, to a remotely located sump. A special valve is illustrated for closing the conduit when the cleaning station and the sump are separated when the reproducing apparatus is opened. U.S. Pat. No. 4,724,459, issued on Feb. 9, 1988 to the same assignee as the present invention, shows the use of a vacuum system for removing collected toner particles from the cleaning apparatus and transporting them to another area for reuse or disposal.

Therefore, as discussed herein, it is desirable and an object of this invention, to provide a cleaning system for electrophotographic apparatus which is easily maintained by the operator. It is also an object of this invention to provide a cleaning system which keeps operator maintenance to a minimum in apparatus which includes an intermediate transfer member from which toner is cleaned.

SUMMARY OF THE INVENTION

There is disclosed herein a new and useful system for cleaning toner and carrier from various surfaces and members in an electrophotographic machine. The cleaning system includes a first cleaning station positioned to clean mainly toner carrier from the main photosensitive member of the machine. The cleaning system also includes a second cleaning station which is positioned to clean mainly toner from an intermediate transfer roller. The toner and carrier collected by both cleaning stations is dropped into a common container or sump which is removable from the machine by the operator to dispose of the collected materials. Thus, the two separate and independent cleaning stations are serviced by the same waste sump, thereby making the machine simpler to maintain by the operator.

One of the cleaning stations includes a non-magnetic roller inside of which is a multi-pole magnet which rotates to pull carrier off of the member it is cleaning and rotate the carrier around the roller to a blade which scrapes the carrier from the roller for ultimate collection in the common sump container. The other cleaning station includes a tacky, conductive silicone roller which also includes a blade for removing the toner particles from the roller and directing them to the sump. This cleaning station is articulated into and out of contact with the intermediate transfer roller, depending upon the presence of a toned image which is not to be disturbed on the roller.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
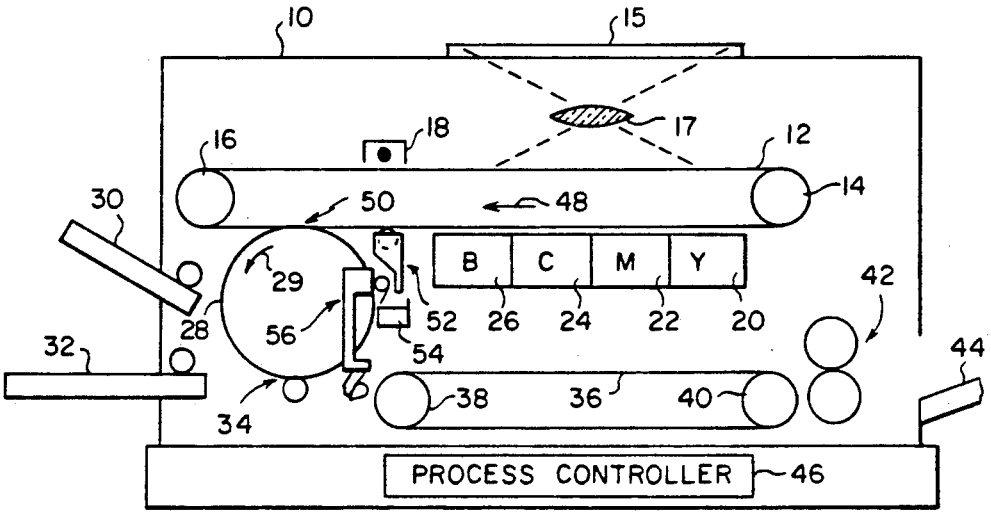
FIG. 1 is a schematic elevational view of a copy machine equipped with the invention disclosed herein.

Throughout the following description, similar reference characters refer to similar elements or members in all of the figures of the drawing.

Referring now to the drawing, and to FIG. 1 in particular, there is shown a copy machine capable of producing color copies from an original document by use of the intermediate transfer process. The copier 10 includes a photosensitive member 12 which can be rotated or moved by the rollers 14 and 16. The member 12 may be any of the photoconductive surfaces customarily used in the copier art, although other forms of image reproduction apparatus may be used within the contemplation of the invention, such as electrostatic image formation.

According to the copier 10 shown in FIG. 1, the original is placed upon the platen 15 where it is imaged onto the photosensitive member 12 by a lens assembly which is shown in FIG. 1 generally by the simple lens 17. Those skilled in the art will appreciate that a more sophisticated optical system ordinarily would be used to place the image upon the photosensitive member 12, and that such optical arrangements are well known in the prior art. It is emphasized that other exposing techniques may be used within the contemplation of the invention, including the use of an electronic exposing system which uses a scanning laser beam or a multi-element, light-generating printhead. A primary charger 18 is used to initially charge the photosensitive member 12, and the toner stations 20, 22, 24 and 26 are used to develop the latent image contained on the member 12. The toner stations contain toner of the color components yellow, magenta, and cyan and a black toner for enhanced contrast and monochrome copies.

The copier shown in FIG. 1 operates with the intermediate transfer process wherein the image developed on the endless photosensitive member, web, or belt 12 is transferred to an intermediate member before being transferred to the copy sheet. In FIG. 1, the intermediate transfer roller or drum 28 rotates synchronously in direction 29 with the movement of the belt 12. Roller 28 receives each of the separate color images in registration before the composite or final image is transferred to a sheet of paper from the paper holding assemblies 30 or 32. Transfer from the roller 28 to the sheet of paper occurs when the sheet of paper enters the transfer area 34 which is located below the intermediate transfer roller 28. The roller is of the continuous, non-seamed surface type. Once the image is transferred to the paper, the paper is conveyed by the conveyor belt 36, which rotates on the rollers 38 and 40, to the fuser station 42. After the fusing operation, which fixes the toner particles onto the flat paper sheet, the paper exits the copier and is deposited in the tray 44. The process contoller 46, along with other apparatus such as motors and encoders, synchronizes and controls the various functions of the copier, including the speed of rotation and movement of the belt 12 and of the imtermediate transfer roller 28.

During the process of making a copy, the developed image(s) on the belt 12 proceed in direction 48 and are transferred to intermediate transfer roller 28 at the first transfer area 50. To remove any toner carrier on the belt 12 before the transfer area 50, the scavenger type film cleaning station 52 is located between the toner stations and the transfer area 50. In some apparatus, a toner cleaning station for the belt 12 may be employed somewhere between the location of the transfer area 50 and the primary charger 18. Carrier cleaned by the station 52 is deposited in the sump or collected waste container 54 which is located vertically below the cleaning station 52. Container 54 is removable by the customer or operator for the purpose of disposing of the collected waste. In this specific embodiment of the invention, the container 54 is removed by pulling it perpendicularly to the plane of FIG. 1. Suitable guides or channels, not shown, would be used to support the container 54 in the copier 10.

A developed image on the intermediate transfer roller 28 is transferred at the transfer area 34 to the paper. Residual toner on the member 28 must also be removed to prevent the degradation of future copies. The cleaner 56, shown in FIG. 1, performs this function. Cleaner 56 removes the excess toner from the roller 28 and also deposits the cleaned toner into the waste container 54. Therefore, the container 54 contains the carrier and toner cleaned by both the cleaning station 52 and the cleaner 56. Consequently, disposal of the waste from both of these cleaning stations can be accomplished by removal of only one container or sump. It is emphasized that toner carrier may contain some toner particles and toner may contain a very small amount of carrier particles.

Figure 2:
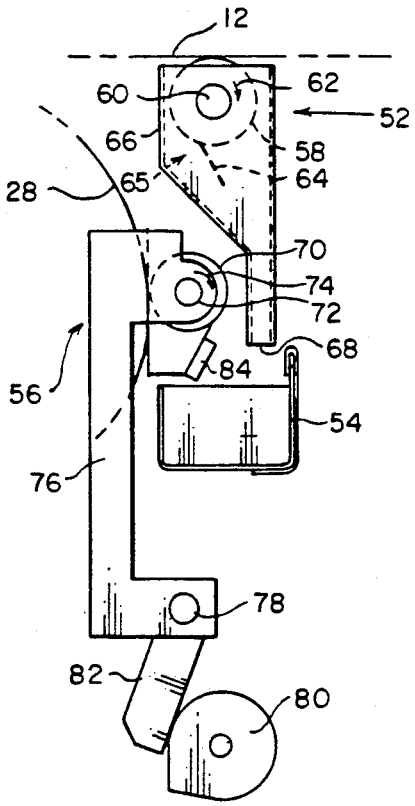
FIG. 2 is a front elevational view of the cleaning system shown in the machine of FIG. 1.

FIG. 2 is a front elevational view of the cleaning system shown in the copy machine of FIG. 1. The scavenger cleaning station 52 includes a cylindrical roller 58 whose axis is coincident with the axis of the shaft 60. The roller 58 is constructed of a non-magnetic material, such as stainless steel, and is located in almost touching relationship with the member 12. A multi-pole magnetic assembly is positioned inside the roller 58 and is rotated in the direction shown by arrow 62. The rotation of the magnetic assembly, which is not shown in FIG. 2, causes the toner carrier particles on the belt 12 to be attracted to the outer surface of the roller 58 and progress or rotate in the direction opposite to that shown by arrow 62. When these carrier particles reach the position where blade 64 contacts the roller 58, the carrier particles are skived off or scraped from the roller 58 and fall down into the inner region 65 of the shroud 66. These particles are routed by the shape of the shroud to the discharge opening 68 where the particles drop into the container 54. As discussed previously in connection with FIG. 1, the waste container 54 may be removed by the operator by pulling the container 54 in a direction perpendicular to the plane of FIG. 2. Once the waste has been emptied, the emptied container 54 is reinserted into the position shown in FIG. 2 for collecting carrier and toner during future operations. As an alternative, the container 54 may be a disposable container whereby, when it is removed, it is discarded completely and a new, empty container is inserted in its place.

Cleaning station 56 removes the residual toner from the intermediate transfer drum or roller 28. Cylindrical roller 70 rotates around shaft 72 in the direction indicated by arrow 74. This roller is a tacky, conductive roller constructed of a suitable material, such as silicone rubber, and is biased by a voltage to attract the toner particles from the roller 28. Since the image area on the roller 28 cannot be disturbed during a revolution when a multiple revolution image process is being used, such as when making color copies, the roller 70 is articulated or moved away from the roller 28 during the passage of intermediate developed images. This is accomplished by the support arm 76 which is pivoted around the shaft 78 and moved in proper synchronization with the developed image on roller 28 by the cam 80 and the cam follower 82.

The toner particles removed by the roller 70 are removed or scraped off of the roller 70 by the blade 84. These toner particles fall vertically, by the force of gravity, into the toner container 54. Consequently, removed or cleaned carrier and toner from both the cleaning station 52 and the cleaning station 56 is collected by the container 54, thereby conveniently permitting the removal of waste from both cleaning stations in one easy operation.

Figure 3:
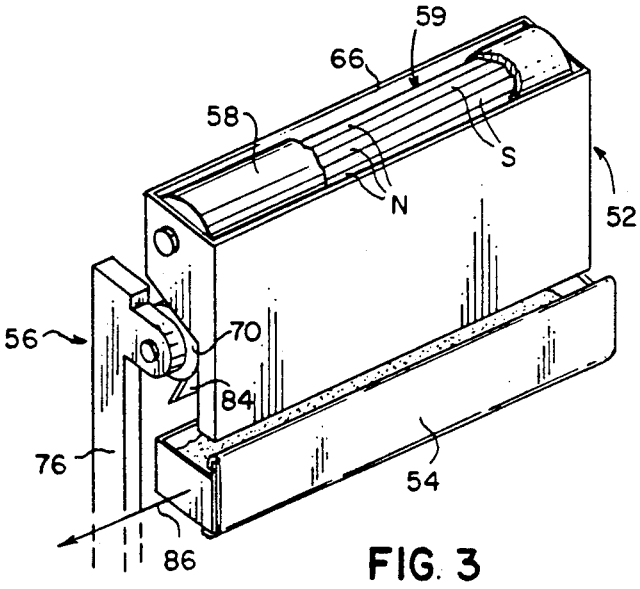
FIG. 3 is a partial isometric view of the cleaning system shown in FIG. 2.

FIG. 3 is a partial isometric view of the cleaning system shown in FIG. 2. The shroud 66 completely encloses the side and lower areas of the roller 58 so that all of the toner carrier collected therefrom falls into the container 54. Arrow 86 indicates the direction of removal of the container 54 from the copy machine and, of course, the opposite direction would indicate the direction for reinserting the container 54 into the copy machine. The guides or tracks upon which the container 54 is positioned are not shown in FIG. 3. The multi-pole magnetic assembly 59, previously discussed in connection with FIG. 2, is shown in the cutaway portion of the roller 58. Alternate poles have the same N or S polarity, as indicated.

There has been shown and described herein a specific embodiment of the invention whereby two separate cleaning stations are serviced by one waste sump or container. The invention disclosed herein is particularly useful with independent cleaning stations, that is, cleaning stations which act separately without cooperation with each other in cleaning particles for the same or different surfaces in the copying apparatus. The only cooperation between the two separately acting cleaning stations is the common collection of the waste particles. Otherwise, each cleaning station performs a separate cleaning function at a separate position or on a separate member of the copying apparatus. Note that the toner container 54 is located substantially below the cleaning station 52, with "substantially" defining the relative positions of the cleaning portions of the devices, not the distance by which they are separated. In this regard, container 54 is also substantially below the cleaning portion of the cleaning station 56, with only the mechanical engaging members actually located below the container 54.

It is emphasized that numerous changes may be made in the above-described system and apparatus without departing from the teachings of the invention. It is intended that all of the matter contained in the foregoing description or shown in the accompanying drawing, shall be interpreted as illustrative rather than limiting.

I claim as my invention:

1. An electrostatographic apparatus for producing hard copies of an original image on a receiver sheet, the apparatus including:

(a) means, including a moving image-bearing member, for forming an electrostatic latent image of such original on said image-bearing member;

(b) toning means, containing toner and magnetic carrier particles, for toning the latent image on said image-bearing member with such toner particles;

(c) scavenger means, located downstream of said toning means, for removing carrier particles from said toned image on said image-bearing member without substantially affecting said toned image;

(d) a rotating intermediate transfer means, mounted downstream of said scavenger means and forming a first image transfer nip with said image-bearing member, for receiving the toned image from said image-bearing member;

(e) means, mounted in contact with said intermediate transfer means downstream of said first image transfer nip and forming a second image transfer nip with said intermediate transfer drum, for transferring said toner image from said intermediate transfer drum onto a receiver sheet to form a hard copy of the original;

(f) a toner cleaning device, mounted in contact with said intermediate transfer means downstream of said second image transfer nip, for removing residual toner particles from said intermediate transfer means, said toner cleaning device being mounted so as to be located directly below said scavenging device; and (g) a common container, located vertically below said toner cleaning device and said scavenging means, for receiving the carrier particles scavenged from the image-bearing member and the residual toner particles removed from the intermediate transfer drum.

2. The electrostatographic apparatus of claim 1 wherein said scavenger means is comprised of a rotatable multi-pole magnetic assembly, a rotatable non-magnetic roller enclosing said magnetic assembly, and a blade member in scraping contact with the outside of said non-magnetic roller for scraping and directing carrier particles away from such roller.

3. The electrostatographic apparatus of claim 2 wherein said scavenger device further includes a housing, having a drop chute portion, for substantially enclosing said non-magnetic roller and said scraping blade.

4. The electrostatographic apparatus of claim 1 wherein said toner cleaning device includes a tacky and conductive cleaning roller, means for mounting said cleaning roller against said intermediate transfer drum, and a blade member in scraping contact with the outside of said cleaning roller for scraping and directing residual toner particles away from such roller.

5. The electrostatographic apparatus of claim 4 wherein said means for mounting said cleaning roller includes a cam and lever assembly for selectively moving said cleaning roller into and out of contact with said intermediate transfer means.

6. The apparatus of claim 1 and wherein the image-bearing member comprises a belt and includes a horizontally extending portion, and further wherein the toning means, scavenger means and intermediate transfer member operate upon said horizontally extending portion.

7. The apparatus of claim 6 and wherein said toning means includes a plurality of toner stations including toner of different colors.

8. The apparatus of claim 1 and wherein said toning means includes a plurality of toner stations including toner of different colors.

9. In an electrostatographic reproduction apparatus, a hybrid cleaning mechanism for scavenging magnetic carrier particles and removing residual toner particles, the cleaning mechanism comprising:

(a) a housing including a top portion and a bottom portion, said bottom portion having a container for holding carrier particles, and toner particles;

(b) a magnetic scavenging element mounted in said top portion of said housing for scavenging magnetic carrier particles from a toned image on a first image-bearing surface without substantially affecting the toned image thereon;

(c) a toner cleaning element mounted between said top and said bottom portions of said housing for removing residual toner particles from a second image-bearing surface;

(d) means for supporting said housing in the electrostatographic reproduction apparatus such that said scavenging element is spaced from said first image-bearing surface, and such that said toner cleaning element is in contact with said second image-bearing surface.

10. In an electrostatographic reproduction apparatus, for producing hard copies of an original image on a receiver sheet, the reproduction apparatus including:

(a) a movable image-bearing surface and means for forming an electrostatic latent image on the image-bearing surface;

(b) toning means containing toner and magnetic carrier particles for toning the latent image on the image-bearing surface; and (c) a movable intermediate transfer member mounted downstream of the toning means and forming a first image-transfer nip with the image-bearing surface for receiving the toned image from the image-bearing surface, and a second image-transfer nip with suitable means for transferring the toned image from the intermediate transfer member onto a receiver sheet, the improvement comprising a hybrid cleaning mechanism having:

(i) a housing including a top portion and a bottom portion containing a sump for holding toner and carrier particles;

(ii) a magnetic scavenging element mounted in said top portion of said housing for scavenging magnetic carrier particles from a toned image on the image-bearing surface without substantially affecting the toned image;

(iii) a toner cleaning element mounted between said top and said bottom portions of said housing for removing residual toner particles from the surface of the intermediate transfer member; and (iv) means for supporting said hybrid cleaning mechanism such that said scavenging element is positioned facing and spaced from the image-bearing surface between said toning means and said first image-transfer nip, and such that said toner cleaning element is in cleaning contact with the surface of the intermediate transfer member.

* * * * *